US005873310A

United States Patent [19]

Creissels et al.

[11] Patent Number: 5,873,310

[45] Date of Patent: Feb. 23, 1999

[54] AERIAL TRANSPORTER HAVING TWO PICKUP SPOTS

[76] Inventors: Denis Creissels, 1 alléde la Piscine, F-38700 Corenc; Jean François Piard, Immeuble le-Genepy, F-73440 Val-Thorens, both of France

[21] Appl. No.: 894,947

[22] PCT Filed: Mar. 20, 1996

[86] PCT No.: PCT/FR96/00413

§ 371 Date: Sep. 4, 1997

§ 102(e) Date: Sep. 4, 1997

[87] PCT Pub. No.: WO96/29223

PCT Pub. Date: Sep. 26, 1996

[30] Foreign Application Priority Data

Mar. 22, 1995 [FR] France ..... 95 03568

[51] Int. Cl.[6] ..... B61B 11/00

[52] U.S. Cl. ..... 104/173.2; 104/28; 104/178

[58] Field of Search ..... 104/27, 28, 173.1, 104/173.2, 178, 179, 184

[56] References Cited

U.S. PATENT DOCUMENTS

| | | | |
|---|---|---|---|
| 3,431,866 | 3/1969 | Bouladon et al. . | |
| 3,548,753 | 12/1970 | Thurston | 104/173.2 |
| 3,987,734 | 10/1976 | Horn . | |
| 4,050,385 | 9/1977 | Gurr et al. . | |
| 4,662,285 | 5/1987 | Rossignol | 104/28 |
| 4,785,738 | 11/1988 | Mollet . | |
| 5,016,539 | 5/1991 | Feuz et al. . | |
| 5,172,640 | 12/1992 | Cathiard | 104/173.2 |
| 5,626,078 | 5/1997 | Fuchs | 104/28 |

FOREIGN PATENT DOCUMENTS

| | | | |
|---|---|---|---|
| 0245163 | 11/1987 | European Pat. Off. . | |
| 0306771 | 3/1989 | European Pat. Off. . | |
| 1436695 | 7/1966 | France . | |
| 2528781 | 12/1983 | France | 104/173.2 |
| 2678571 | 1/1993 | France | 104/28 |

*Primary Examiner*—Mark Tuan Le
*Attorney, Agent, or Firm*—Oliff & Berridge PLC

[57] ABSTRACT

A loading station of a detachable chair-lift comprises two spots 22, 29 for alternate pickup of skiers 21. To give the skiers easy access to the pickup spots, the distance between the chairs is increased by grouping them in pairs in the access zones. The station may comprise two tracks 16, 17, each having a pickup spot, onto which the chairs 11, uncoupled from the rope, are directed alternately. The two pickup spots can be on the same track, one after the other, the grouping of the chairs in pairs then being modified when running between the two pickup spots so that the rear chair of the pair at the first is pickup spot comes in front at the second pickup spot.

10 Claims, 9 Drawing Sheets

AERIAL TRANSPORTER HAVING TWO PICKUP SPOTS

BACKGROUND OF THE INVENTION

The invention relates to a detachable chair-lift having an aerial rope with continuous running, which extends between two stations where the rope passes over bull-wheels to form an endless loop, and chairs coupled to the rope on the line and uncoupled from the rope in the stations to run continuously over a trajectory transferring the chairs from one strand of the loop to the other passing pickup spots to pick up skiers.

The invention is described hereinafter in its preferred application to a detachable chair-lift, and more particularly to a loading station generally situated downhill, but it is clear that it is applicable to other transporters, notably to cable-cars.

The transport capacity is an essential factor of a chair-lift and it depends on the number of places on each chair and on the speed of and the distance between the chairs on the line. The development of detachable chair-lifts has enabled the speed on the line and therefore the throughput rate to be increased, while providing ease of pickup on chairs running at reduced speed. As the speed of the chairs in the stations is lower, the chairs are closer to one another than on the line, notably in the pickup zone, and at a high throughput rate, the larger the size of the chairs, with two, three or four seats, the more difficult it is for skiers to pass between two chairs close to one another.

The object of the present invention is to achieve a chair-lift with a high transport capacity and with loading in complete safety.

The document U.S. Pat No. 4,050,385 describes a detachable chair-lift, whose transfer trajectory of the chairs is doubled into two parallel tracks, each having a pickup spot. The chairs are directed alternately onto one or the other of the tracks so as to increase the throughput rate of the installation. The two tracks cross and the pickup spots are arranged on the outside sections of the tracks. The skiers are seated perpendicularly to the line and they get on the chairs, at a standstill, from the rear, without crossing the trajectory of the chairs or one of the tracks. Loading at a standstill reduces the running rate of the chair-lift and, at the crossing of the two tracks, one of the chairs is loaded and the slightest misadjustment may cause an accident with injury.

The document EP-A-0,306,771 describes a parking track of a detachable chair-lift, on which the chairs are stored at a small distance from one another.

SUMMARY OF THE INVENTION

Grouping of the chairs in pairs, according to the invention, increases the distance between the rear chair of one pair and the front chair of the following pair. This grouping can be controlled by a rhythm changing device arranged at the entry of the station to modify the slowing down speed of the chairs after the latter have been uncoupled from the rope. The rhythm changing device can also be located in the uphill station so as to group the chairs in pairs as soon as the latter exit this station, unequal distribution of the chairs along the line not being a drawback as these chairs are empty.

According to a first embodiment of the invention, the transfer trajectory is doubled by a branchoff into an inside track and an outside track, each having a pickup spot with an access path. A switching points device directs the chairs alternately onto one or the other of the tracks and the frequency with which the chairs pass a pickup spot is thus divided by two, in such a way that the pickup operation is made easier. It is moreover conceivable to provide three or a larger number of tracks to reduce this frequency even more. Access to a pickup spot on the outside track does not give rise to any difficulty. The inside track is on the other hand surrounded by the outside track and the access path to the pickup spot of the inside track has to cross a track. By grouping the chairs in pairs, according to the invention, the distance between the chairs, in this case the distance between the pairs of chairs, is increased and it is. easier for the skiers to pass between the pairs of chairs to reach the pickup spot. The risk of collision between a chair and a skier moving forward on the access path is thus notably reduced and almost equivalent to that of conventional chairlifts, crossing zone of the access path and the tracks. A gate, disposed on the access path, advantageously controls the entry of the skiers to this access path.

According to an alternative embodiment of the invention, the two tracks are, in the crossing zone, both curved in the direction of the pickup spot and the front chair, seen in the direction of movement, in the pair of chairs is directed by the switching points onto the inside track. This curving of the tracks enables the crossing zone to be rapidly cleared by the chairs. The front chair follows the most curved trajectory and therefore approaches a lagging skier from behind, without any great risk of accident.

According to another alternative embodiment, the inside track and the outside track, each in the shape of a half-loop, are arranged in the axis of the line, staggered along this axis. In this case the front chair is preferably directed in the switching points onto the outside track. This front chair crosses the access path perpendicularly, whereas the rear chair branches off onto the inside track clearing the access path rapidly.

The arrangement of the two tracks and their trajectory may be different and be determined by the site or the structure of the station, but the two tracks never cross to prevent any risk of collision between the chairs and complicated synchronization devices. The lengths of the tracks and the speeds of movement of the chairs on these tracks are such that the chairs have the same running rate on leaving the tracks as when starting on the tracks, with a possible change in the order of the chairs.

It should be noted that the pickup station can easily be arranged for alighting of skiers, by providing an alighting spot on each of the tracks, before the pickup spot.

According to another embodiment of the invention, the two pickup spots are located one after the other on the same track. The chairs are grouped in pairs a first time to pass the first pickup spot and a second time to pass the second pickup spot, with switching of the grouped chairs so that the chair which was at the front of the pair when entering the first pickup spot and which picked up skiers at this first pickup spot is at the rear of the pair when entering the second pickup spot. The pickup spots are arranged in a curve of the track so that the access paths to these pickup spots are tangent to the curve and these two pickup spots are appreciably at right angles. Gates, synchronized with the running of the chairs, control entry of the skiers to the access path.

Alighting on arrival is less critical than embarking and can often be achieved, in the usual manner, with a simple slope. It is however possible to use a system with two tracks each having an alighting spot, similar to the embarkment device. A simplified version, according to the invention, comprises a transfer trajectory doubled into two parallel tracks, each of which presents an alighting spot in the form of a ramp. A switching points device directs the chairs alternately onto one track and onto the other track and the two ramps are sloping to enable the skiers to clear the way by passing normally under the chairs and the track. Any risk of collision with a chair is thus excluded.

BRIEF DESCRIPTION OF THE PREFERRED EMBODIMENTS

Other advantages and features will become more clearly apparent from the following description of two embodiments of the invention, given as examples only and represented in the accompanying drawings, in which.

Figure 1:
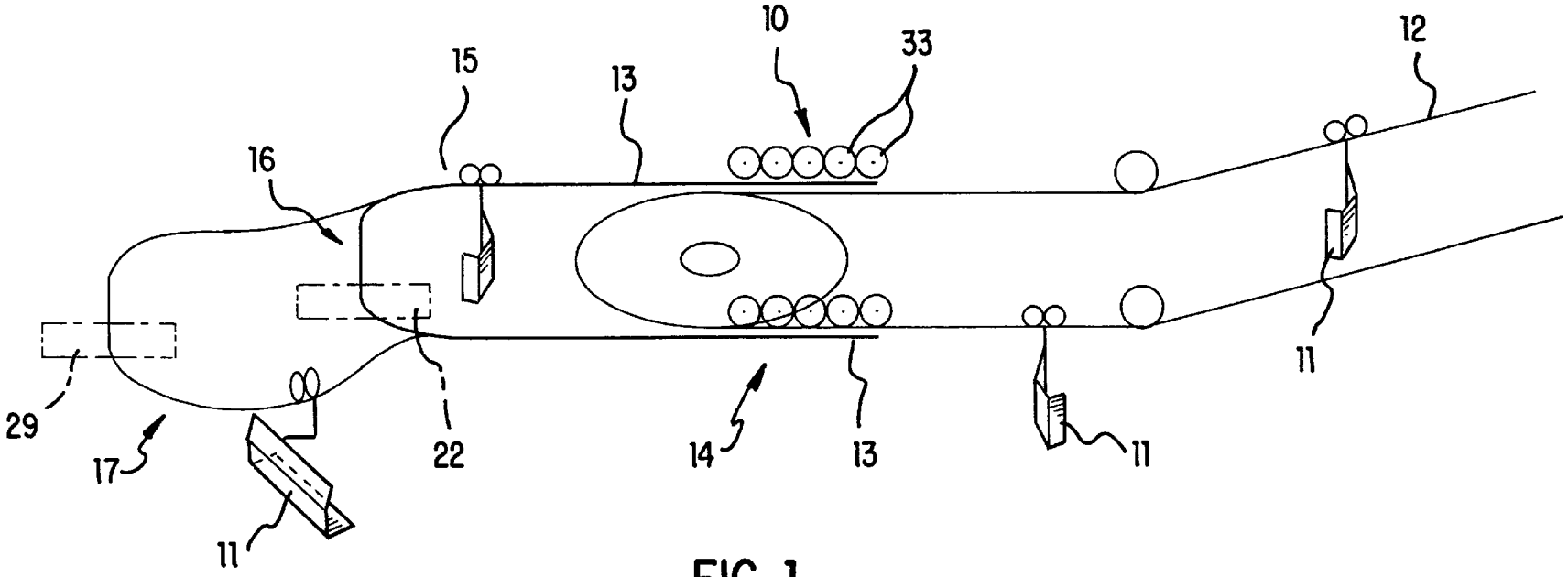
FIG. 1 is a schematic perspective view of a loading station of a chair-lift according to the invention.
Figure 2:
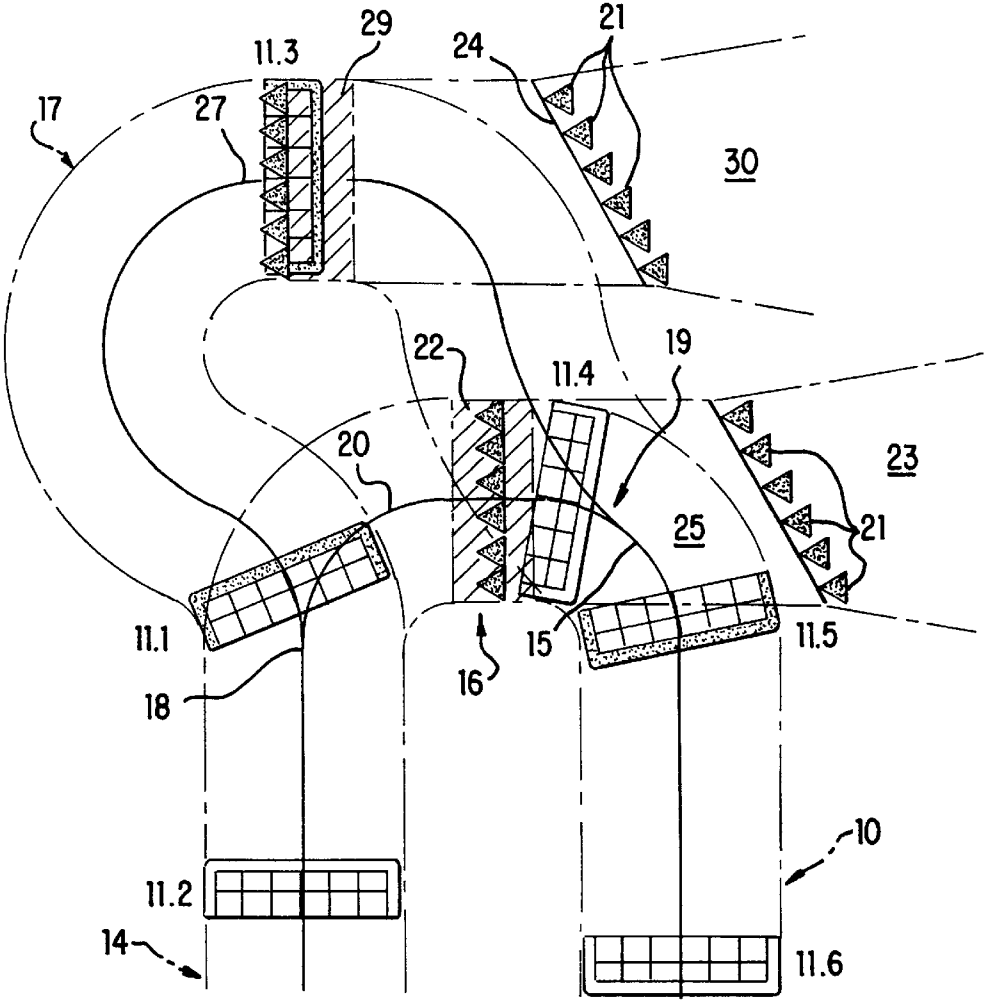
FIGS. 2 to 5 are plan views of the station according to FIG. 1, respectively showing the successive positions of the chairs.

In FIGS. 1–6 a pickup station of a detachable chair-lift comprises at the entry to the station a zone 10 for detachment of the chairs 11 from a rope 12 and for deceleration of these chairs, which run on a rail 13 to be transferred to the exit from the station where they are reaccelerated over an acceleration zone 14 before being recoupled to the opposite strand of the rope 12. Driving and deceleration of the chairs 11 uncoupled from the rope 12 is performed by any appropriate means, for example by chains with cleats and sets of tyred wheels 33. Detachable chair-lifts of this kind, with loading at reduced speed, are well known and it is not necessary to describe them in greater detail here.

According to the invention a switching points device 15, located after the deceleration zone 10, enable the chairs 11 to be directed selectively onto an inside track 16 or an outside track 17. The two tracks 16, 17 are connected by a switching points device 18 to the acceleration zone 14 and the outside track 17 runs around the inside track 16. The trajectory for transfer of the chairs 11 from one strand of the rope 12 to the opposite strand is thus doubled by the two tracks 16, 17 which each comprise a rail 13 and associated propulsion means. The inside track 16 is in the shape of a half-loop, arranged in the axis of the line in the usual manner. It comprises a curved part 20 on which there is scheduled a pickup spot 22 with an access path 23, whose axis is appreciably tangent to the curve 20. The chairs 11 are six-seaters, but this number may be different and the access path 23, with six gates 24, enables six skiers 21, represented in the figures by triangles, to move forward in a row to the pickup spot 22. The outside track 17 is a deformed half-loop with a lateral offset so as to follow at the beginning the curvature of the inside track 16 and to present a first part 19 curved in the same direction as the inside track 16 in the direction of the pickup spot 22. Succeeding this first part 19 there is a curved part 27 having, appreciably in the middle, an pickup spot 29 with an access path 30 whose axis is tangent to the curve 27. The access path 30, with six gates 24, enables six skiers 21 to move forward in a row to the pickup spot 29. The two access paths 23 and 30 are parallel and side by side, the path 30 of the outside track 17 directly accessing the pickup spot in the usual manner from the rear, whereas the path 23 of the inside track 16 crosses the outside track 17, the crossing zone 25 coinciding with the branchoff zone with a switching points device 15. The pickup spot 22 of the inside track 16 is adjacent to the crossing zone 25 and the gates 24 are disposed just before this crossing zone 25. The distance to be covered by the skiers 21 between the gates 24 and the pickup spot 22 is thus limited as far as possible. The same gates 24 control passing of the crossing zone 25 and access to the pickup spot 22. The gates 24 are arranged obliquely on the path to more or less follow the curvature of the tracks 16, 17 and their opening may be progressive as the chair 11 passes.

According to a first embodiment of the invention, the deceleration device 33 of the chairs 11 is arranged to modify the running rhythm of the chairs 11 and to move them together in twos to form pairs of chairs close to one another which pass the crossing zone 25 together. This moving together of the chairs may be achieved either by stopping one chair 11 at the entry of the crossing zone 25 to wait for the next chair or preferably by modulating the decelerations so that the two chairs 11 reach the entry of the crossing zone 25 together and pass this zone at the same time. It is clear that the distance separating the pairs of chairs 11 is increased and that the skiers can pass between the pairs of chairs more easily to reach the pickup spot 22. According to an alternative embodiment, modification of the running rhythm of the chairs is performed in the uphill station, the empty chairs already being grouped in pairs on the line so as to simplify the downhill pickup station.

The length of the outside track 17 is greater than that of the inside track 16 and if the chairs 11 run over the tracks 16, 17 at the same speed, the difference of length has to be determined so that the normal regular rhythm is again achieved at the exit, with a modification of the order of the chairs, the chair of the short inside track 16 passing in front of one or two chairs of the long outside track 17. The rhythm can also be re-established by different speeds of the chairs 11 on the tracks 16, 17 or in the acceleration zone 14.

Operation of the installation can be understood from FIGS. 2 to 5. At the time represented in FIG. 2, a pair of chairs 11.4 and 11.5 have been slowed down and moved together in the deceleration zone 10 so as to pass the crossing and branchoff zone 25 at slow speed and together. The first chair 11.4 has just passed the switching points device 15 which directed it onto the inside track 16 in the direction of the pickup spot 22. The second chair 11.5 of the pair enters the crossing zone 25 and will be directed onto the outside track 17. The access path 23 is closed by the gates 24 which prevent the skiers 21 from engaging in the crossing zone 25 and from accessing the pickup spot 22 of the inside track 16. The preceding chair 11.3 is on the curved part 27 of the outside track 17 at the pickup spot 29, whereas the preceding chair 11.2 which followed the short inside track 16 is engaged on the acceleration zone 14 and has overtaken the first chair 11.1 which followed the long track 17. It can be seen that the chair 11.6 which follows the pair of chairs 11.4, 11.5 is notably at a distance from this pair.

Figure 3:
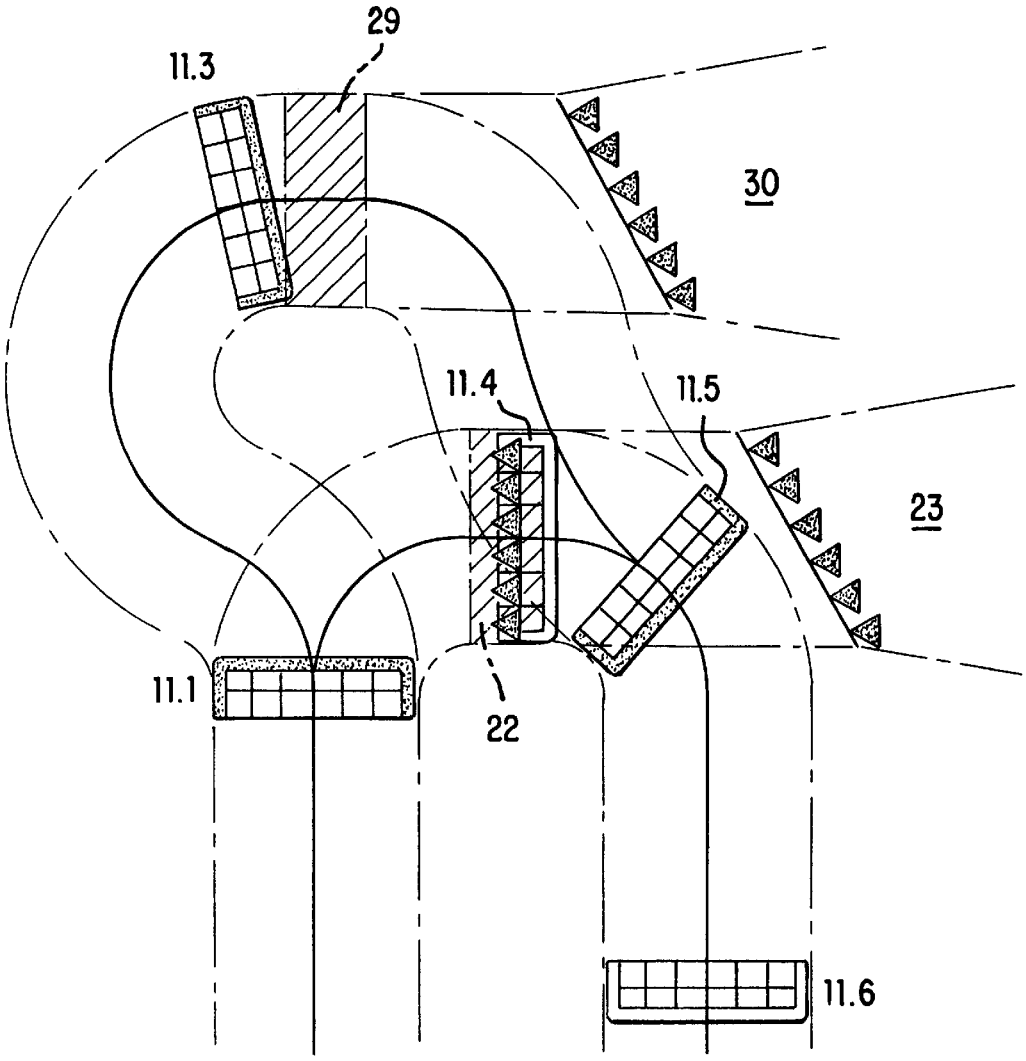
Figure 4:
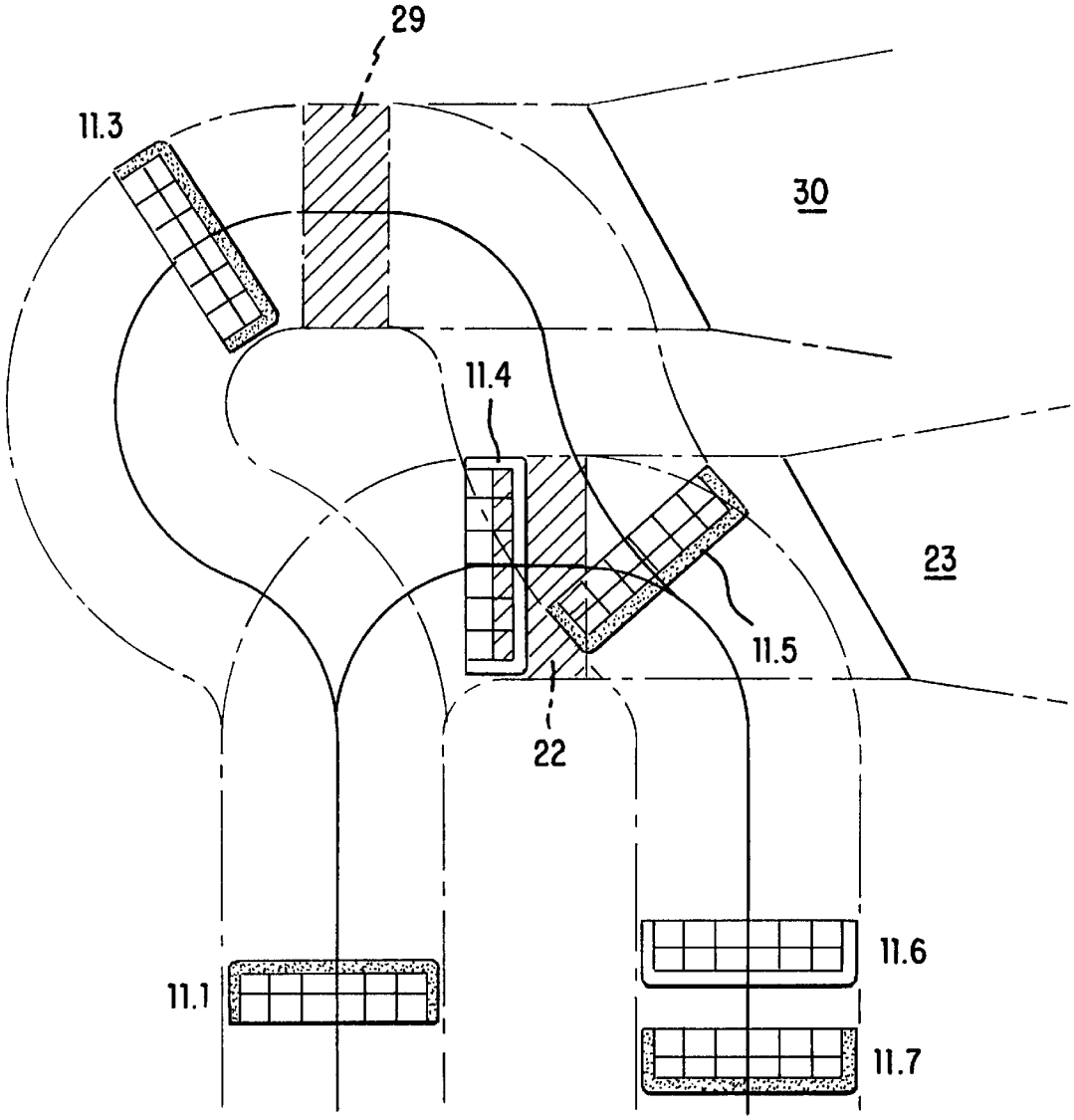
Figure 5:
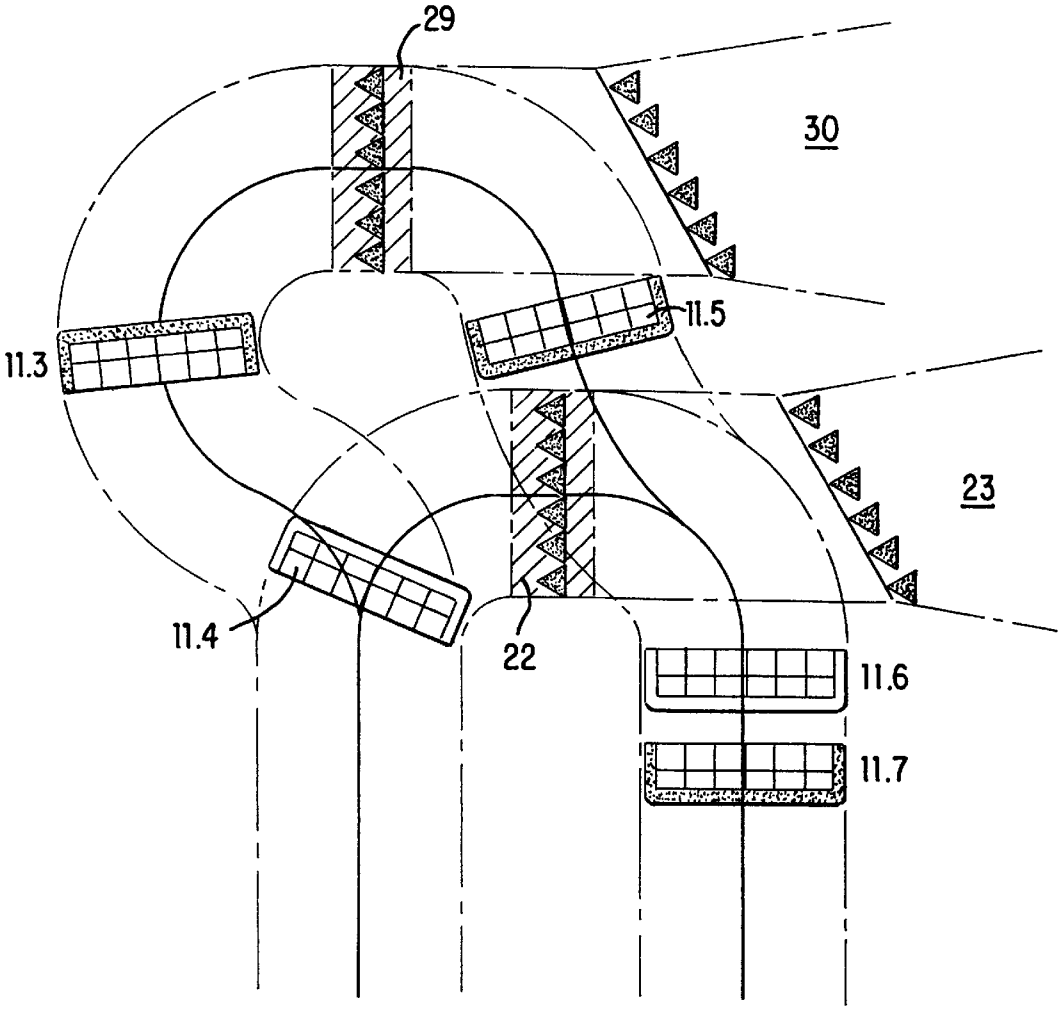

At the time represented in FIG. 3, the chair 11.4 is at the pickup spot 22 and the chair 11.5 is engaging on the outside track 17. The following FIGS. 4 and 5 illustrate the progression of the different chairs 11 which are directed alternately onto the inside track 16 and the outside track 17 by the switching points device 15, and opening of the gates 24. It is not necessary to describe this operation in greater detail.

Figure 6:
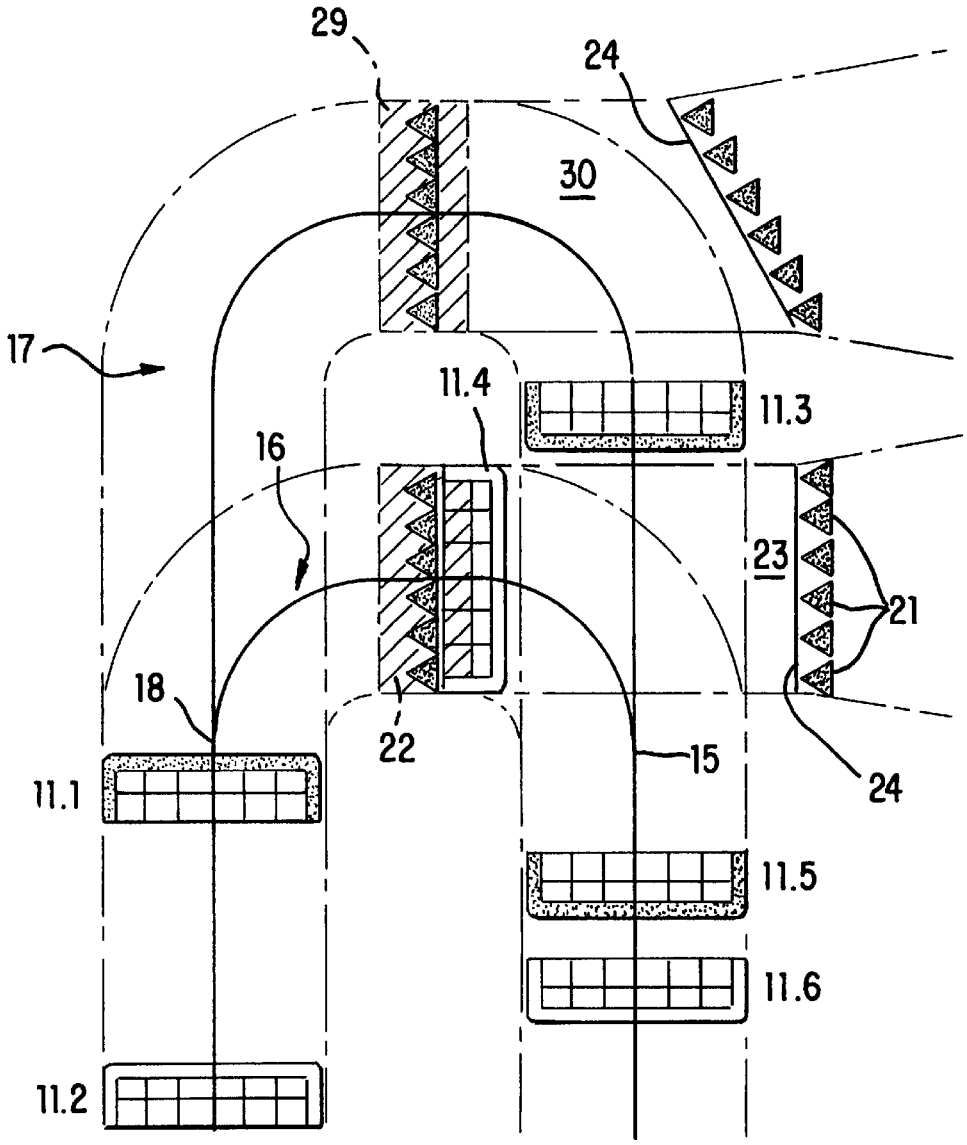
FIG. 6 is a similar view to that of FIG. 2 illustrating an alternative embodiment according to the invention.

FIG. 6 illustrates another arrangement of the tracks 16, 17 wherein the outside track 17 is a half-loop also arranged in the axis and in the extension of the line, and is staggered with respect to the half-loop of the inside track 16. The access path 23 of the inside track 16 is then appreciably perpendicular to the outside track 17. In this alternative embodiment the chair 11.5, which will be directed onto the outside track 17, is at the front in the pair of chairs 11.5, 11.6 and the chair 11.6 at the rear clears the crossing zone quickly turning out to the side onto the inside track 16. Operation is naturally identical to that described above with reference to FIGS. 2 to 5.

It is clear that the access paths 23, 30 and associated pickup spots 22, 29 can be located at any other part of the curves 20, 27 according to the space available and the structure of the station. It is conceivable to provide a third branchoff track to increase the spacing apart of the chairs 11. Each track 16, 17 can comprise an pickup spot located before the pickup spot 22, 29, these places not having to be in the curves 20, 27.

Figure 7:
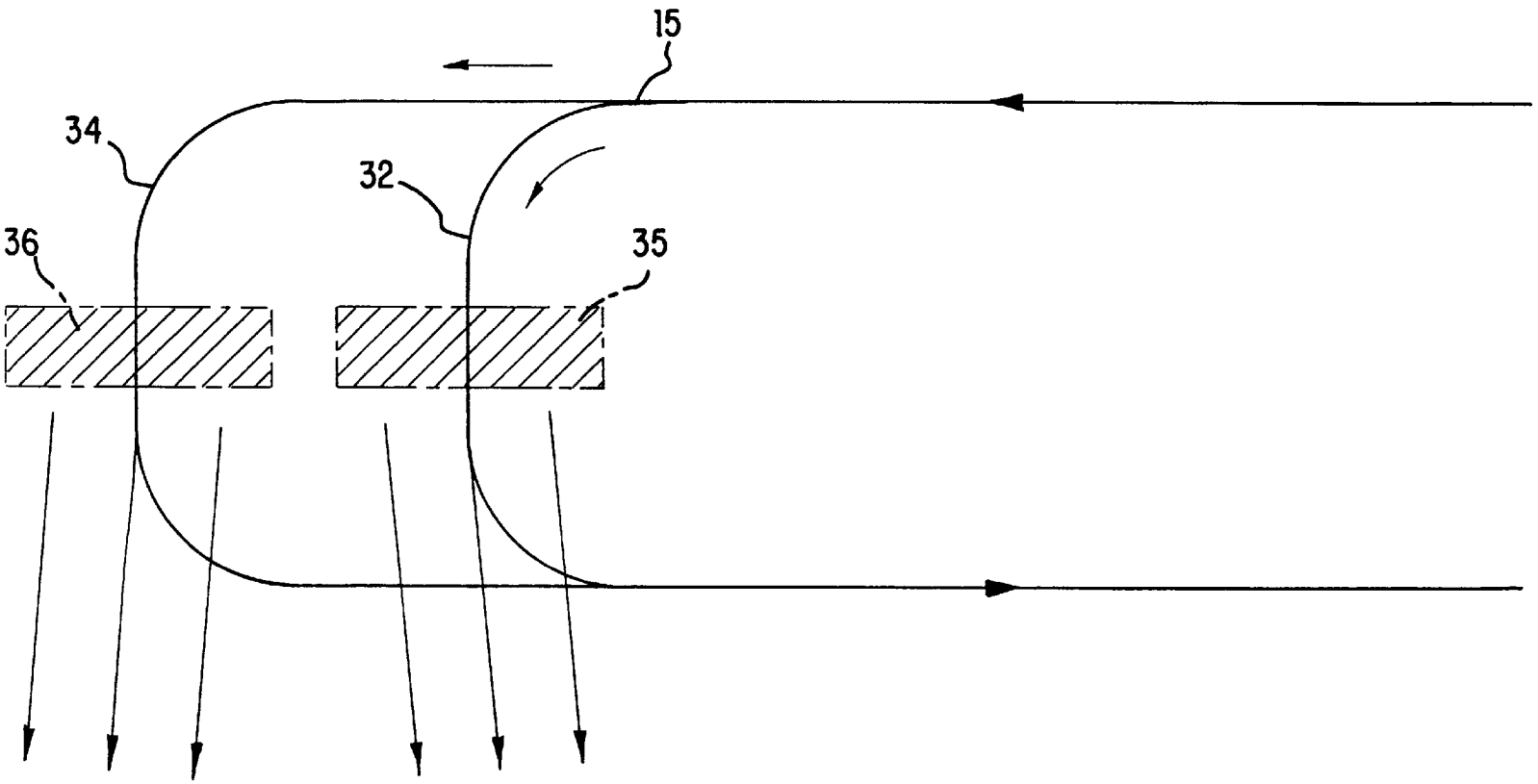
FIG. 7 is a schematic plan view of an alighting station according to the invention.

The arrival station can be appreciably identical to the departure station with doubled tracks. Depending on the running rate and structure of the installation a standard station with a single track may be sufficient, as alighting from a chair is easier than getting on. FIG. 7 illustrates a simplified alighting station wherein the chairs are alternately directed onto two adjacent parallel tracks 32, 34 each having a sloped alighting ramp 35, 36 which makes the skiers pass under the chairs 11 and tracks 32, 34 in the manner indicated by the arrows in the figure, without any risk of collision.

Figure 8:
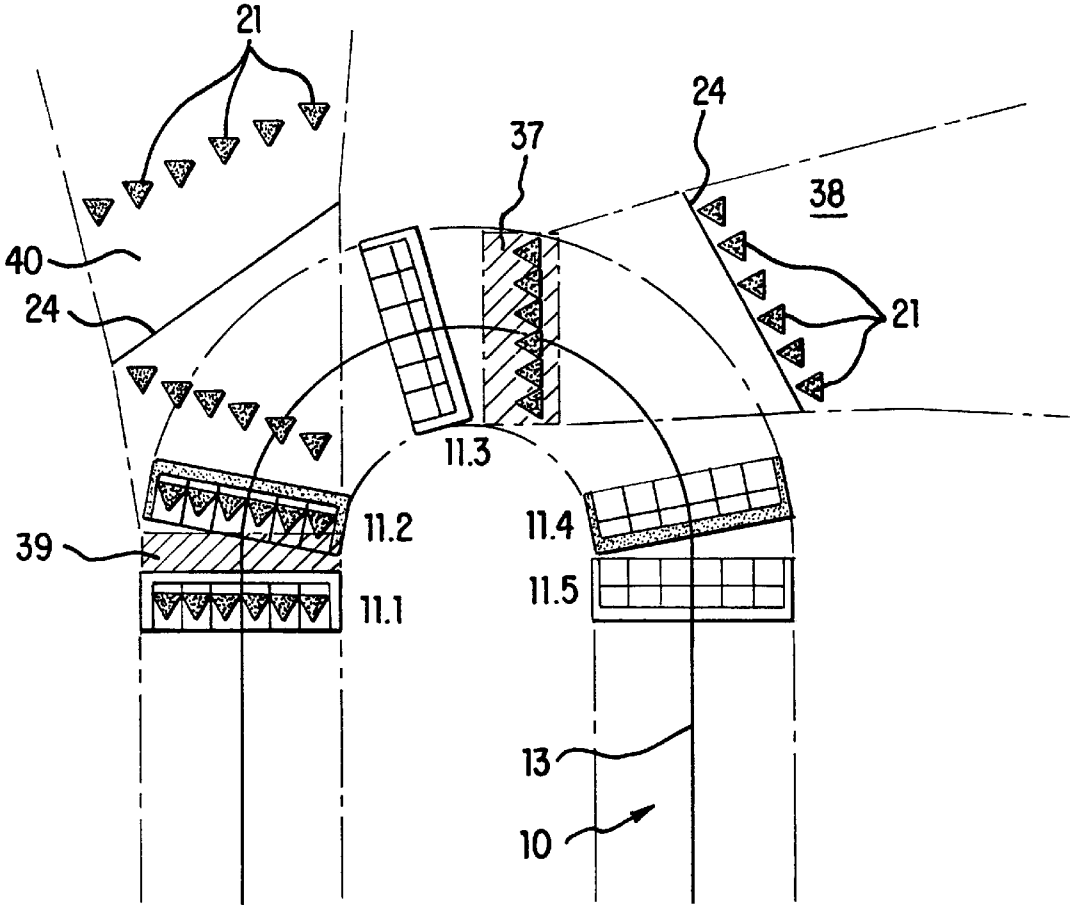
FIGS. 8 and 9 are similar views to FIGS. 2 and 3, illustrating another embodiment of the invention.
Figure 9:
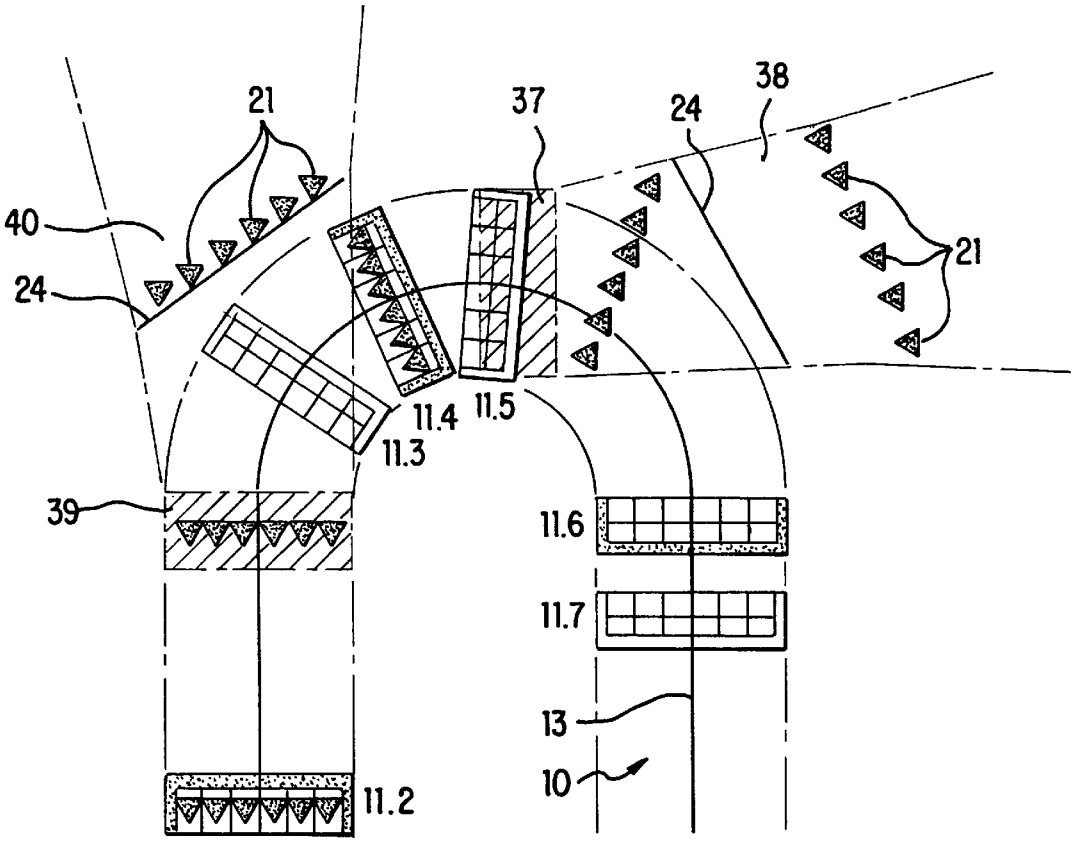

According to another embodiment of the invention illustrated by FIGS. 8 and 9, the pickup station comprises a single track 13 in the shape of a half-loop extending the line in the usual manner. Two pickup spots 37, 39 with their access paths 38, 40 are arranged in the curve of the track, respectively in the middle of and at the exit from the curve, so that the set of chairs 11 pass successively through the two pickup spots 37, 39. The two pickup spots 37, 39 are appreciably perpendicular to one another and the access paths 38, 40, tangent to the curve, are equipped with gates 24 whose opening is synchronized with the running of the chairs 11. In the manner described above, the chairs 11 arrive, at the beginning of the curve, grouped in pairs and are moved together to the first pickup spot 37 where the front chair of the pair picks up the skiers 21. It can be understood that between the two pickup spots 37, 39 grouping of the chairs 11 in pairs has to be modified so that the rear chair of the pair at the first pickup spot 37 arrives in front at the second spot 39 to pick up the skiers. This switching is achieved by slowing down and/or speeding up the successive chairs so as to group the still empty chair with the chair which follows it and separate it from the chair preceding it. It can be understood that the skiers 21 have more time to move forward on the access paths 38, 40 and place themselves at the pickup spots 37, 39. Operation is clearly apparent from FIGS. 8 and 9 which represent the position of the chairs 11 at two successive moments. In FIG. 8 a pair of chairs 11.4, 11.5 reach the beginning of the curve, ready to cross the access path 38 and to pick up on the front chair 11.4 the skiers waiting at the first pickup spot 37. The chair 11.3, which was grouped with the preceding chair 11.2 to pass the first pickup spot 37, has separated from the latter chair 11.2 and is waiting for the next chair 11.4 to cross the access path 40 of the second pickup spot 39 together, where it will pick up the skiers who move forward to this second pickup spot 39. FIG. 9 represents this moment when the pair of chairs 11.4, 11.5 have passed the first pickup spot 37 and caught up with the preceding chair 11.3, which moves forward grouped with the chair 11.4 to the second pickup spot 39 crossing the access path 40. The chair 11.5 at the rear of the pair of chairs 11.4, 11.5 has slowed down to separate from the chair 11.4 and wait for the next chair 11.6 of the following pair 11.6, 11.7. The chairs 11.1, 11.2 which area leaving the curve have picked up one 11.1 skiers at the second pickup spot 39 and the other 11.2 skiers at the first pickup spot 37. It should be noted that the distance separating the pairs of chairs 11.4, 11.5 and 11.6, 11.7 is greater than the distance separating chairs regularly spaced apart, and that it is therefore easier for the skiers to pass between the pairs of chairs. It is not necessary to described the operation in greater detail, this operation being clearly apparent from examination of FIGS. 8 and 9.

What is claimed is:

1. A detachable chair-lift, comprising:

a continuously running aerial rope extending between a downhill pickup station and an uphill dropoff station, the rope forming a part of an endless loop; and a plurality of chairs coupled to the rope between the downhill pickup station and the uphill dropoff station, the chairs being uncoupled from the rope in the downhill pickup station and in the uphill dropoff station, a trajectory of transfer of the chairs doubles from the rope to an inner track of the loop and an outer track of the loop when the chairs are uncoupled from the rope, each track of the loop passing by at least one pickup spot where the skiers get picked up by the chairs, each pickup spot being positioned such that the skiers access the pickup spots by passing between the chairs which are grouped in pairs before being forwarded to the pickup spots, whereby the distance between the chairs in each pair is reduced and the distance between the pair of chairs and a second chair in a preceding pair of chairs and a first chair in a subsequent pair of chairs is increased such that access to the pickup spots is easier for the skiers.

2. The chair-lift according to claim 1, further comprising:

a rhythm changing device that modifies a running speed of the chairs to group the chairs in pairs.

3. The chair-lift according to claim 1, further comprising:

a rhythm changing device that modifies a slowing down speed of the chairs before the chairs have been uncoupled from the rope so as to move consecutive chairs towards one another and group the consecutive chairs together.

4. The chair-lift according to claim 1, further comprising:

a rhythm changing device located in the uphill dropoff station to group the chairs in pairs as soon as the chairs leave the uphill dropoff station.

5. The chair-lift according to claim 1, further comprising:

a branchoff zone where the trajectory of transfer of the chairs doubles into the inside track and the outside track, a pick up spot of each track having an access path;

a switching points device that alternately directs the chairs onto the inside track and the outside track; and a crossing zone of the trajectory of transfer of the chairs and the access path to the pickup spot of the inside track wherein the chairs are grouped in pairs so that the distance between the pairs of chairs is increased, thereby making it easier for the skiers to pass between the pairs of chairs to reach the pickup spot of the inside track.

6. The chair-lift according to claim 5, wherein the branchoff zone substantially coincides with the crossing zone.

7. The chair-lift according to claim 1, wherein the pickup spots are consecutively positioned on the same track so that the pair of chairs pass successively through the pickup spots, whereby the second chair at a first pickup spot in the preceding pair of chairs is the first chair at a second pickup spot.

8. The chair-lift according to claim 1, further comprising:

access paths for the skiers to access the pickup spots wherein the pickup spots are arranged on a curve of each track such that the access paths to the pickup spots are tangent to the curve of each track.

9. The chair-lift according to claim 1, further comprising:

access paths for the skiers to access the pickup spots, and a gate arranged on each access path to control access to the pickup spots, each gate being synchronized with a running speed of the chairs.

10. The chair-lift according to claim 1, wherein the inside track and outside track are parallel, each track having a sloping alighting spot enabling the skiers to pass under the chairs and tracks without a risk of collision and a switching points device that alternately directs the chairs onto the inside track and the outside track.

* * * * *